US008248236B2

(12) United States Patent
Perez et al.

(10) Patent No.: US 8,248,236 B2
(45) Date of Patent: Aug. 21, 2012

(54) SWING TICKET HOUSING

(75) Inventors: Sergio M. Perez, Lake Worth, FL (US); Anthony Joseph Sharpy, Boynton Beach, FL (US)

(73) Assignee: Sensomatic Electronics, LLC, Boca Raton, FL (US)

( * ) Notice: Subject to any disclaimer, the term of this patent is extended or adjusted under 35 U.S.C. 154(b) by 372 days.

(21) Appl. No.: 12/559,734

(22) Filed: Sep. 15, 2009

(65) Prior Publication Data

US 2010/0079284 A1 Apr. 1, 2010

Related U.S. Application Data

(60) Provisional application No. 61/194,296, filed on Sep. 27, 2008.

(51) Int. Cl.
*G08B 13/14* (2006.01)

(52) U.S. Cl. ..... 340/568.1

(58) Field of Classification Search ..... 340/568.1, 340/572.8, 572.9, 693.5; 40/299.01
See application file for complete search history.

(56) References Cited

U.S. PATENT DOCUMENTS 3,942,829 A * 3/1976 Humble et al. ..... 70/57.1
3,974,581 A * 8/1976 Martens et al. ..... 340/572.7
6,774,794 B2 * 8/2004 Zimmerman et al. ..... 340/572.8
7,474,216 B2 * 1/2009 Skjellerup et al. ..... 340/572.1
2003/0116632 A1 6/2003 Zimmerman et al.
2006/0187055 A1 * 8/2006 Colby ..... 340/572.7
2007/0186597 A1 8/2007 Kolton et al.
2007/0273523 A1 11/2007 Skjellerup et al.

FOREIGN PATENT DOCUMENTS

DE 102004052543 A1 5/2006
WO 02/03837 A1 1/2002

OTHER PUBLICATIONS

International Search Report dated Dec. 30, 2009 for International Application Serial No. PCT/US2009/005216, International Filing Date Sep. 17, 2009 consisting of 13-pages.

* cited by examiner

*Primary Examiner* — Phung Nguyen
(74) *Attorney, Agent, or Firm* — Alan M. Weisberg; Christopher & Weisberg, P.A.

(57) ABSTRACT

A swing ticket holder for securing a swing ticket to an item using a lock and a pin includes a rigid housing arranged to retain the swing ticket. The pin extends outwardly from the rigid housing. The pin is insertable into the lock to secure the swing ticket holder to the item. The lock can be part of a security system hard tag and include at least one of an electronic article surveillance element and a radio frequency identification element. The rigid housing can also be arranged to retain at least one of an electronic article surveillance element and a radio frequency identification element.

20 Claims, 10 Drawing Sheets

SWING TICKET HOUSING

CROSS-REFERENCE TO RELATED APPLICATION

The present invention is related to and claims priority to U.S. Provisional Patent Application No. 61/194,296, filed Sep. 27, 2008, entitled SWING TICKET HOUSING, the entire contents of which is incorporated herein by reference.

STATEMENT REGARDING FEDERALLY SPONSORED RESEARCH OR DEVELOPMENT n/a

FIELD OF THE INVENTION

The present invention relates generally to swing tickets used for inventory and merchandising purposes which may include integral EAS and/or RFID elements, and more specifically to a method and apparatus for a rigid plastic swing ticket housing which can be used in combination with an EAS hard tag.

BACKGROUND OF THE INVENTION

Information tickets or stickers which contain information about a retail item or other merchandise, such as a price, barcode identification, manufacturer's information, etc., are commonly known as swing tickets. These swing tickets are affixed to corresponding merchandise and can be manufactured with embedded electronic article surveillance ("EAS") or radio frequency identification ("RFID") components. Current solutions involve imbedding electronic sensors inside a thin stock printed swing ticket, usually constructed from cardboard. However, this method does not protect the ticket or sensor inside from damage or tampering. The current approach also does not prevent bending, tearing or removal of the swing ticket itself.

Swing tickets made from cardstock are typically attached to items such as clothing and other textiles using thin plastic tagging pins. The plastic tagging pins are attached using a tagging gun which pierces the item to simultaneously insert the pin and the swing ticket. A disadvantage of this system is that the swing ticket can be easily damaged or removed. Removing the swing ticket can be accomplished without the use of tools, since the ticket can be either torn away from the pin or the pin manipulated to allow the extraction of the ticket. Another disadvantage is that once the swing ticket is removed, price switching becomes a possibility. If the ticket includes an RFID label, unauthorized removal will result in compromised data integrity and errors. If the ticket includes an EAS sensor and is removed, the product is left unprotected from possible theft.

Therefore, what is needed is a method and apparatus for protecting a swing ticket from damage or removal by effectively securing the swing ticket to its associated item.

SUMMARY OF THE INVENTION

The present invention advantageously provides a swing ticket holder, system and method for securing a swing ticket to an item of merchandise. Generally, the swing ticket is retained within a rigid housing and secured to the item using a pin and a lock. The swing ticket holder may include a cavity for retaining electronic article surveillance ("EAS") and/or radio frequency identification ("RFID") elements, or may be used in combination with an EAS hard tag.

In accordance with one aspect of the present invention, a swing ticket holder is provided for securing a swing ticket to an item using a lock and a pin. The swing ticket holder includes a rigid housing arranged to retain the swing ticket. The pin extends outwardly from the rigid housing and is insertable into the lock to secure the swing ticket holder to the item.

In accordance with another aspect of the present invention, an EAS system is provided for securing a swing ticket to an item of merchandise. The EAS system includes a swing ticket holder which has a rigid housing arranged to retain the swing ticket, an EAS hard tag and a pin securing the swing ticket holder to the EAS hard tag through the item of merchandise.

In accordance with yet another aspect of the present invention, a method is provided for securing a swing ticket to an item of merchandise. A swing ticket is inserted into a swing ticket holder. The swing ticket holder is secured to the item of merchandise by inserting a pin through the item into a lock. The pin extends from the swing ticket holder.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 2:
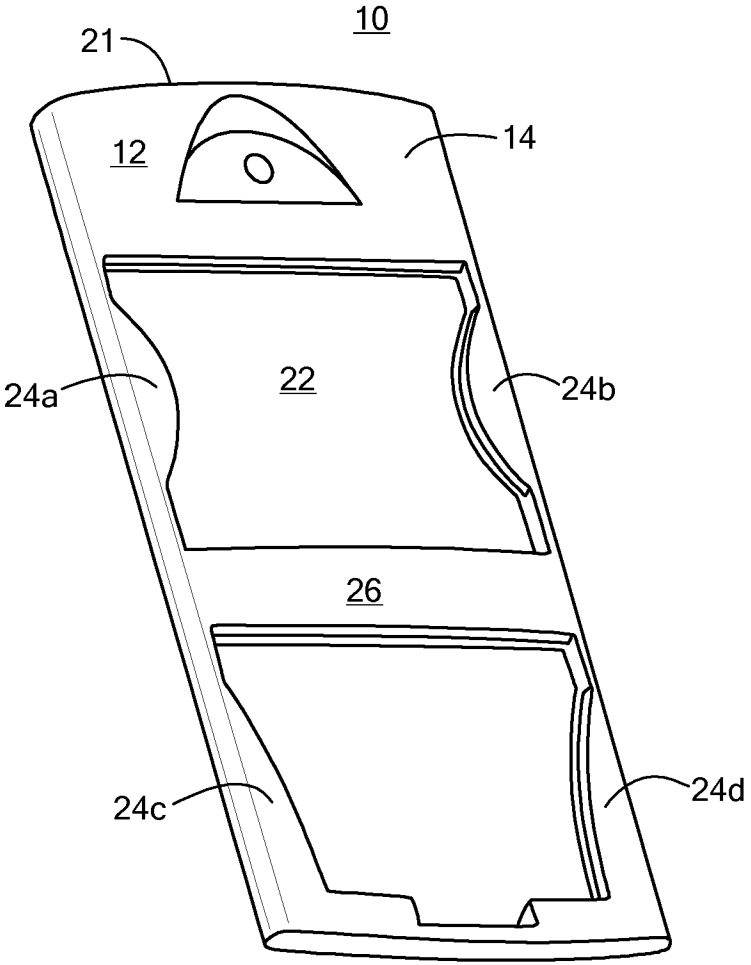
FIG. 2 is a perspective view of the exemplary swing ticket holder of FIG. 1.

Before describing in detail exemplary embodiments that are in accordance with the present invention, it is noted that the embodiments reside primarily in combinations of apparatus components and processing steps related to implementing a swing ticket holder for use in conjunction with radio frequency identification ("RFID") and/or electronic article surveillance ("EAS") systems. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," "front" and "back," and the like, may be used solely to distinguish one entity or element from another entity or element without necessarily requiring or implying any physical or logical relationship or order between such entities or elements.

One embodiment of the present invention advantageously provides a swing ticket holder which is both a merchandising tool for displaying printed material to the consumer in an aesthetically pleasing manner, and a housing to protect the printed material and electronic sensors and RFID devices which can be disposed therein. The swing ticket holder can be advantageously locked to an item using a pin and clutch arrangement which is releasable only by an authorized detaching device.

Figure 1:
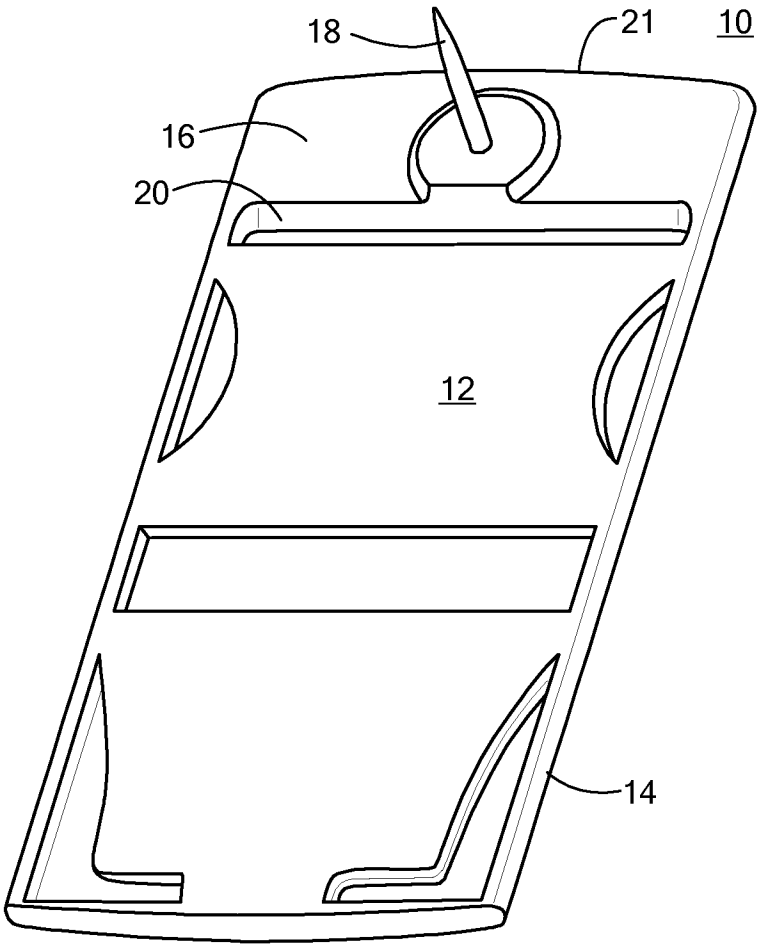
FIG. 1 is a perspective view of an exemplary swing ticket holder constructed in accordance with the principles of the present invention.

Referring now to the drawing figures in which like reference designators refer to like elements, there is shown in FIG. 1 a rear perspective view of one embodiment of an exemplary swing ticket holder 10 constructed in accordance with the principles of the present invention. The swing tag holder 10 includes a rigid plastic housing 12 which is configured to house a cardstock ticket (not shown) having visual indicia thereon. The rigid plastic housing 12 has a generally flat configuration and may optionally house EAS and/or RFID elements (not shown). The swing tag holder 10 has a front side 14 and a back side 16. The back side 16 may include a protruding metal pin 18. The metal pin 18 may engage with a clutch mechanism disposed in a lock (not shown) to firmly secure the swing ticket holder 10 to an item of merchandise. The housing 12 may also include a slot 20 along the top edge 21 which allows insertion of the cardstock ticket. After the cardstock is inserted into slot 20, the swing ticket holder 10 is then attached to the item of merchandise using the metal pin 18 and engaged with a clutch mechanism. The location of the pin 18, relative to the location of slot 20 while on an item of merchandise, will not allow the cardstock to slide up and be removed. To remove the cardstock ticket, the swing ticket holder 10 must be completely removed from the item of merchandise to enable the cardstock to slide out.

Referring now to FIG. 2, a front perspective view of the exemplary swing ticket holder shown in FIG. 1 is provided. The front side 14 of the housing 12 includes a window area 22, which may be open or at least partially transparent to allow visibility of the cardstock ticket (not shown). In an open configuration, the cardstock ticket may be secured by one or more tabs 24*a*, 24*b*, 24*c*, 24*d* (collectively referenced as "tab 24") or guard bars 26 which prevent the cardstock ticket from being removed without damaging the ticket.

Figure 4:
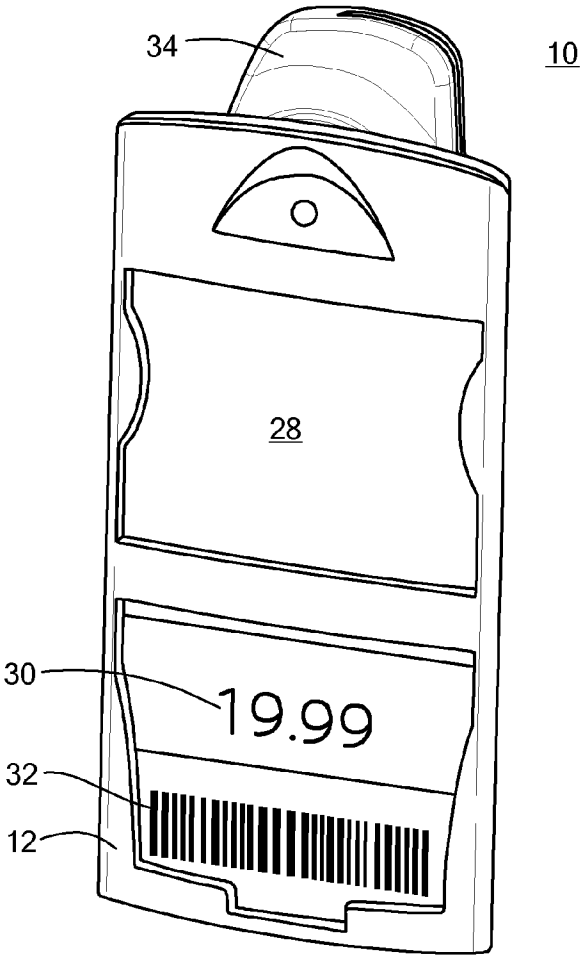
FIGS. 3 and 4 illustrate one mode of use of the exemplary swing tag holder shown in FIGS. 1-2 according to the principles of the present invention.
Figure 3:
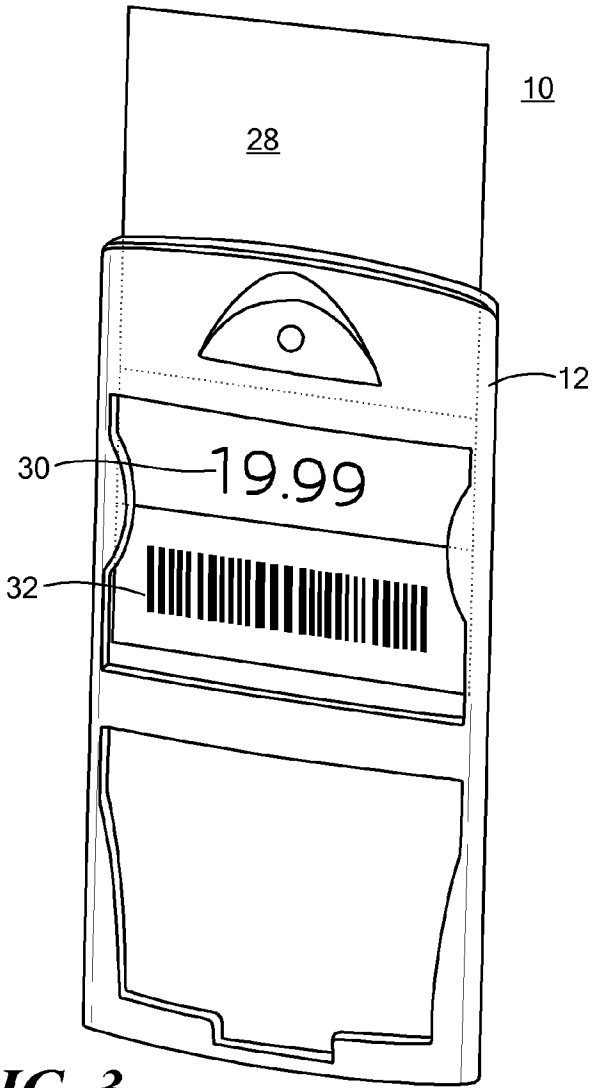

Referring now to FIGS. 3 and 4, one mode of use of the swing tag holder 10 shown in FIGS. 1 and 2 is illustrated. In FIG. 3, a cardstock ticket 28 having both human readable data 30 and machine readable data 32, such as a barcode, is inserted in to the housing 12 through the slot 20. FIG. 3 shows the ticket partially inserted, while FIG. 4 shows the swing tag holder 10 fully inserted and attached to an EAS tag 34 by insertion of the pin 18 into the cooperating clutch portion of the EAS tag 34. Thus, an embodiment of the swing ticket holder 10 of the present invention advantageously functions as a component of a standard EAS hard tag theft deterrent system while also providing a means of securely locking the cardstock swing ticket to an item.

Figure 5:
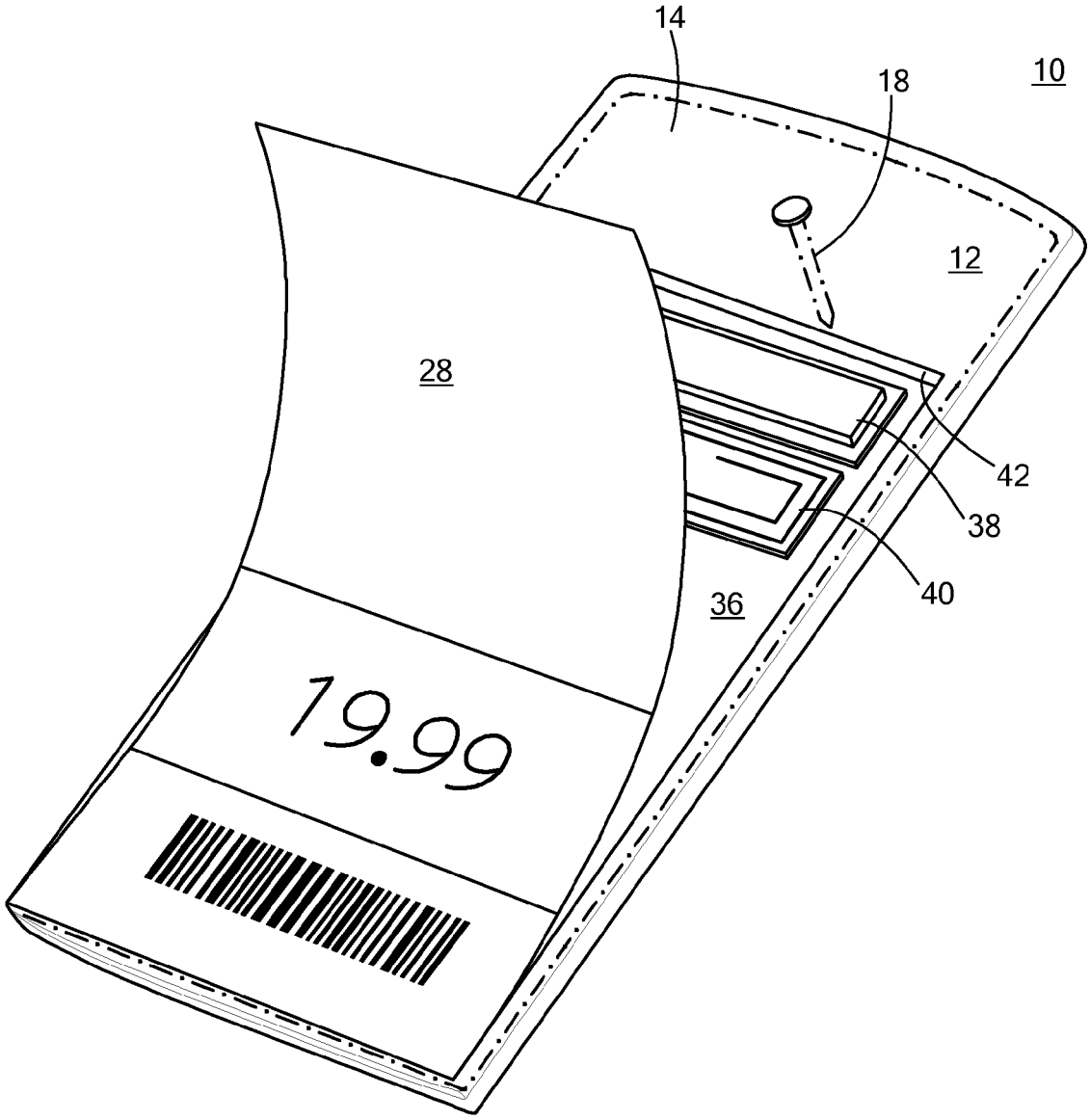
FIG. 5 is a perspective view of the exemplary swing ticket holder of FIG. 1 illustrating the placement of EAS and RFID elements into the housing according to the principles of the present invention.

The swing ticket holder 10 may also be attached to a locking component including a clutch mechanism which does not include an EAS sensor. FIG. 5 illustrates an arrangement where a card 36 (or printed circuit board) containing EAS 38 and/or RFID 40 elements is placed into a shallow cavity 42 within the housing 12, and a printed cardstock ticket 28 is positioned on top of the EAS 38 and/or RFID 40 elements to effectively conceal them from view. It should be noted that the components of the EAS 38 and/or RFID 40 elements are commonly known and are therefore not described in detail herein. An EAS 38 and/or RFID 40 element may be a magneto-acoustic EAS tag which may include, among other things, an antenna electrically coupled to a transceiver which may be controlled by a processor or microprocessor. Locking pin and clutch arrangements such as those used in EAS hard tagging systems are known in the art, and also are not discussed herein in detail.

Figure 7:
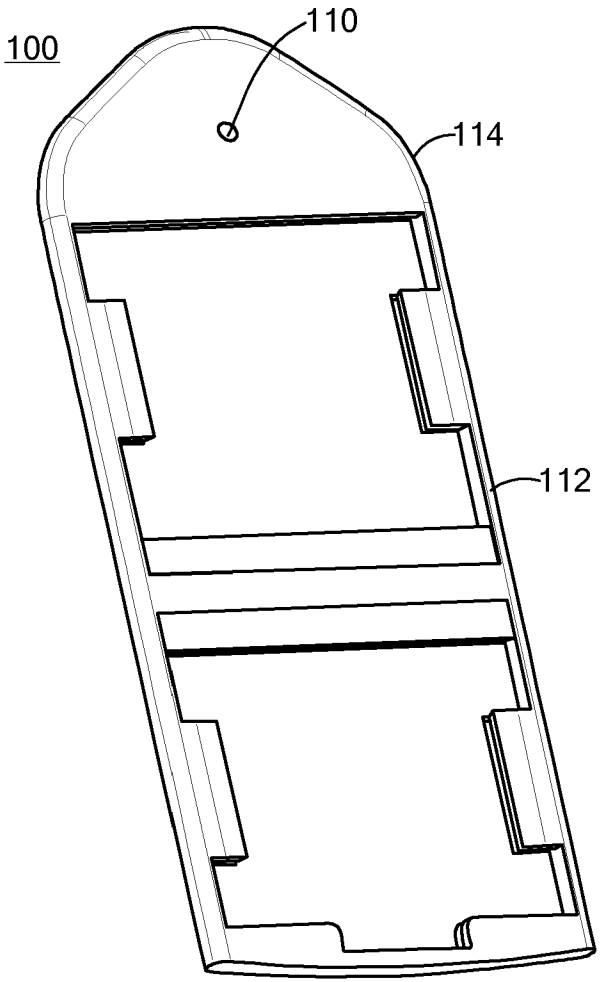
FIG. 7 is a rear perspective view of the alternative swing ticket holder of FIG. 6.
Figure 6:
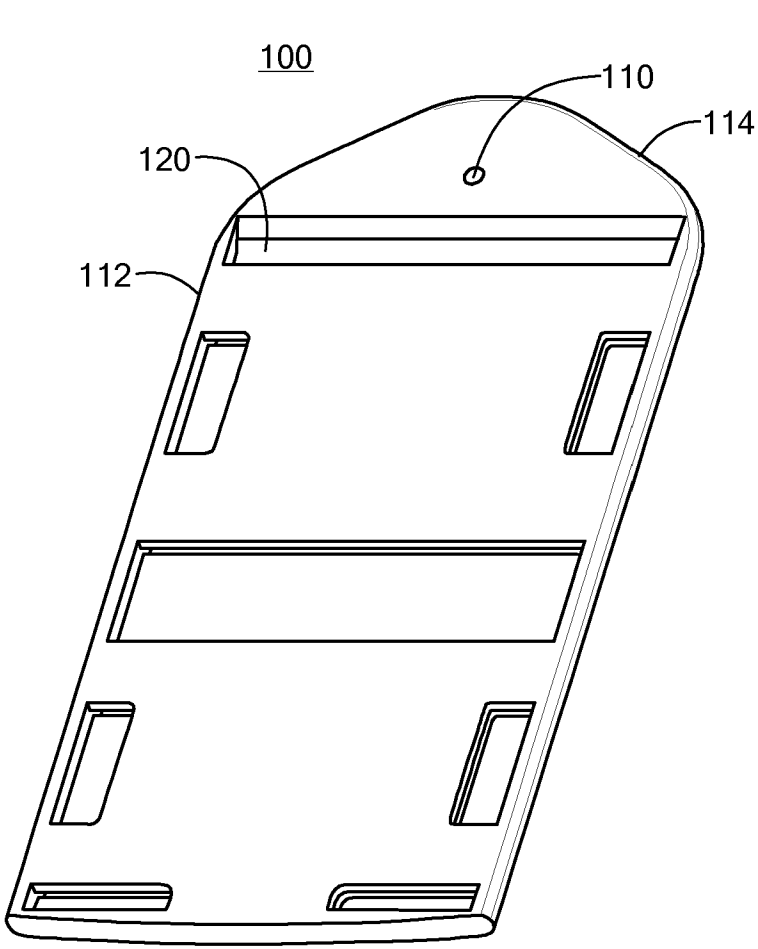
FIG. 6 is a front perspective view of an alternative embodiment of a swing ticket holder constructed in accordance with the principles of the present invention.

Referring now to FIGS. 6 and 7, an alternative embodiment of the present invention is shown. FIG. 6 illustrates a front perspective view of swing ticket holder 100. FIG. 7 illustrates a rear perspective view of swing ticket holder 100. Swing ticket holder 100 is similar to swing ticket holder 10, described above in relation to FIGS. 1-5; however, instead of having an integrated pin, swing ticket holder 100 includes an aperture 110 in the generally flat rigid plastic housing 112, positioned near the upper edge 114. In use, the swing ticket holder 100 may be attached to an item by insertion of the pin component from an EAS hard tag (not shown) through the aperture 110 and then engaging the pin with the clutch component of the EAS hard tag. Additionally, the card 36 from FIG. 5, containing EAS 38 and/or RFID 40 elements may also be used with this alternative embodiment to include RFID capabilities and/or if an EAS hard tag pin/clutch is not used.

Figure 8:
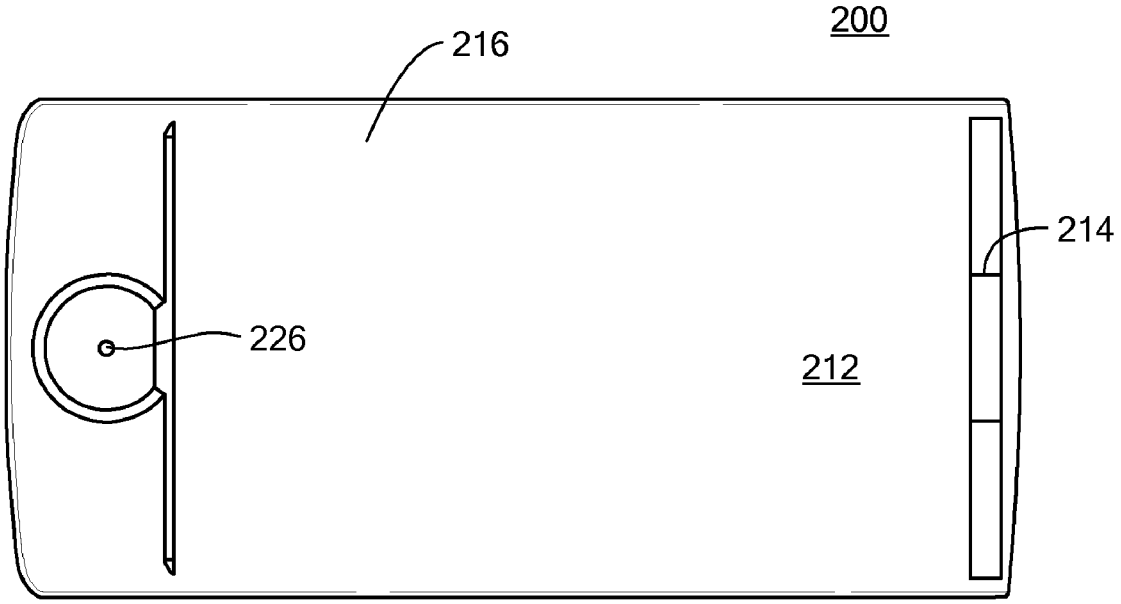
FIG. 8 is a front view of another alternative embodiment of a swing ticket holder configured to open in a clamshell manner, constructed in accordance with the principles of the present invention.
Figure 9:
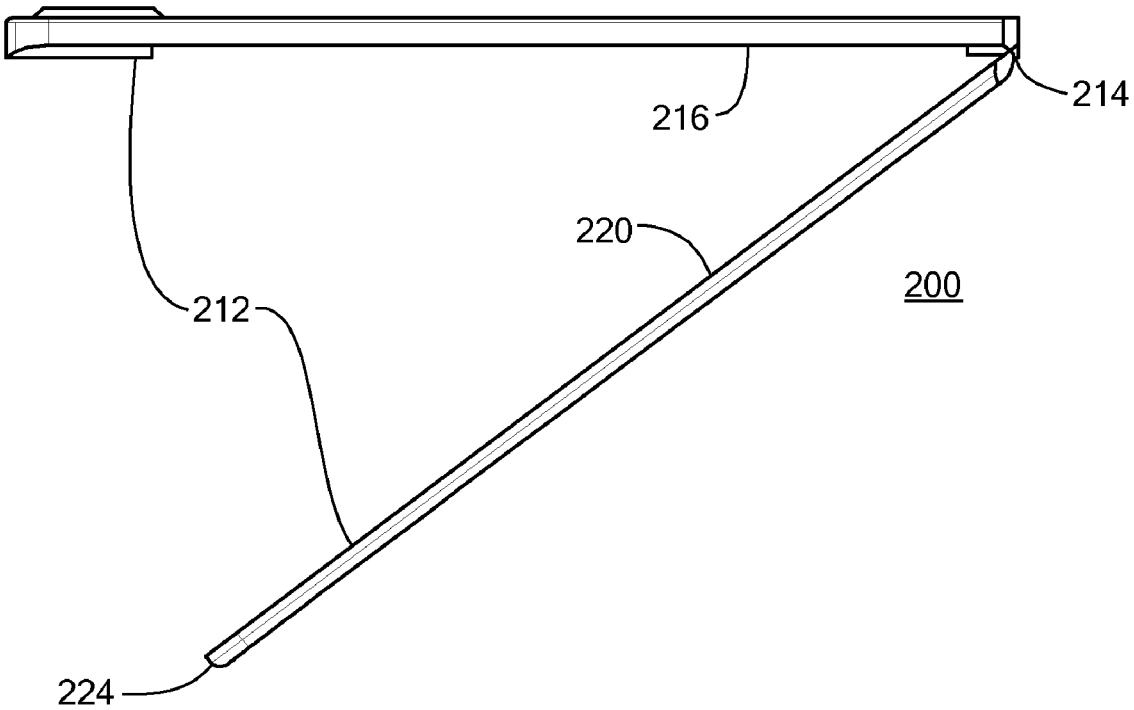
FIG. 9 is a side view of the clamshell swing ticket holder of FIG. 8.
Figure 10:
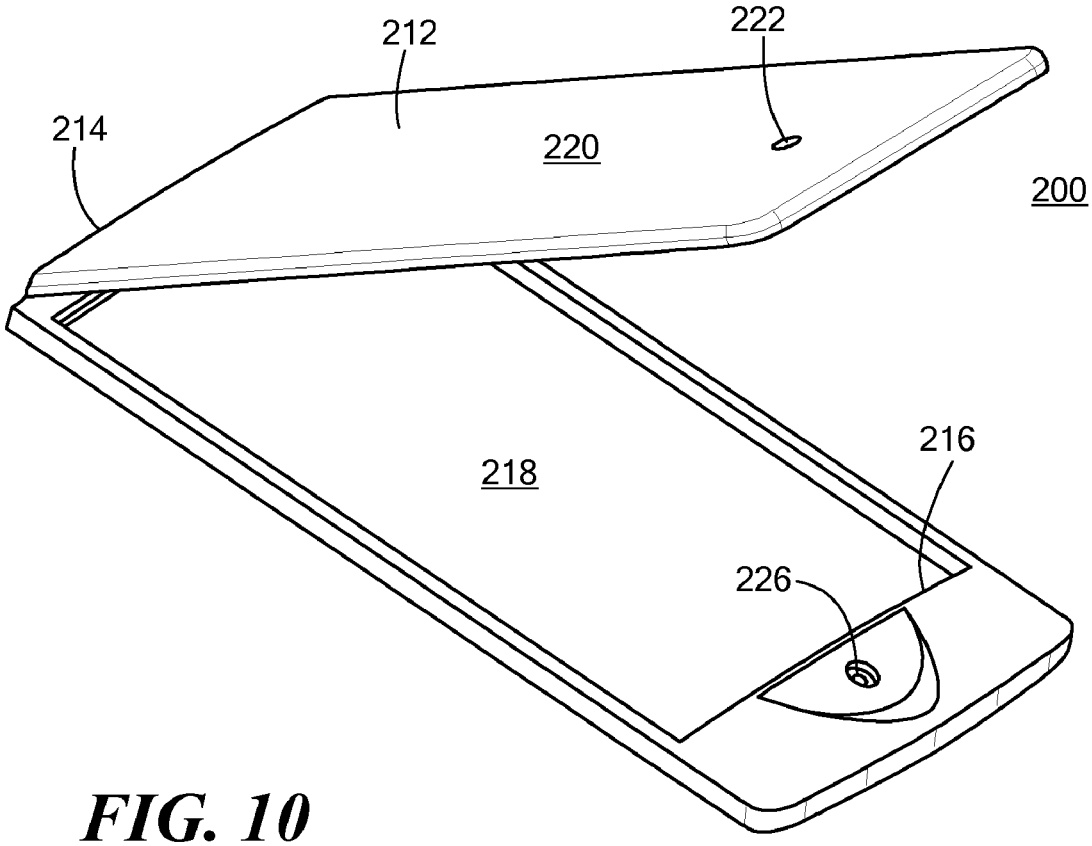
FIG. 10 is a perspective view of the clamshell swing ticket holder of FIG. 8.

Another alternative embodiment of the present invention is shown in FIGS. 8-10. FIG. 8 illustrates a front view of swing ticket holder 200. FIG. 9 illustrates a side view of swing ticket holder 200. FIG. 10 illustrates a perspective view of swing ticket holder 200. Swing ticket holder 200 includes a housing 212 having a hinged lower edge 214, which allows the housing 212 to be opened in a clamshell arrangement. The back side 216 of the housing 212 includes a cavity 218, while the front side 220 is generally flat. This configuration allows a printed ticket (not shown) and EAS/RFID components, such as those shown on card 36 of FIG. 5, to be inserted into a cavity 216 and removed as needed. The front side 220 of the housing 212 includes a first aperture 222 positioned near the upper edge 224 of the clamshell housing 212, which substantially aligns with a second aperture 226 in the back side 216 of the housing 212 when the housing is in a closed position. The clamshell housing 212 may be secured in a closed position by inserting a pin component from an EAS hard tag (not shown) through both apertures 222, 226 and then engaging the pin with the clutch component of the EAS hard tag. Additionally, the card 36 from FIG. 5, containing EAS 38 and/or RFID 40 elements may also be used with this alternative embodiment to include RFID capabilities and/or if an EAS hard tag pin/clutch is not used.

Figure 11:
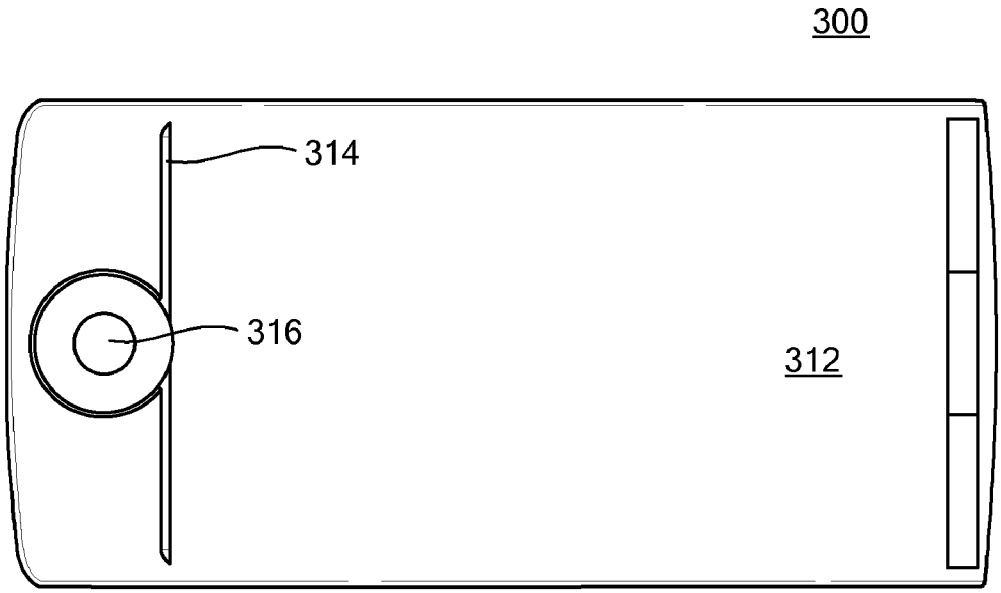
FIG. 11 is a front view of another alternative embodiment of a swing ticket holder having an integrated clutch mechanism to receive a pin, constructed in accordance with the principles of the present invention.
Figure 12:
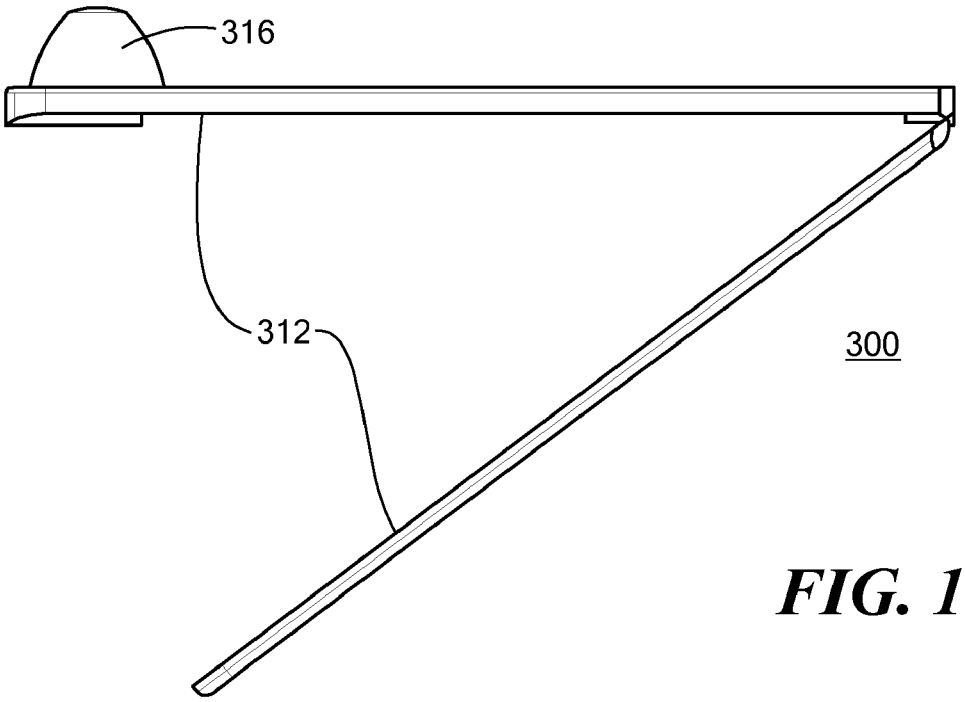
FIG. 12 is a side view of the alternative swing ticket holder of FIG. 11.
Figure 13:
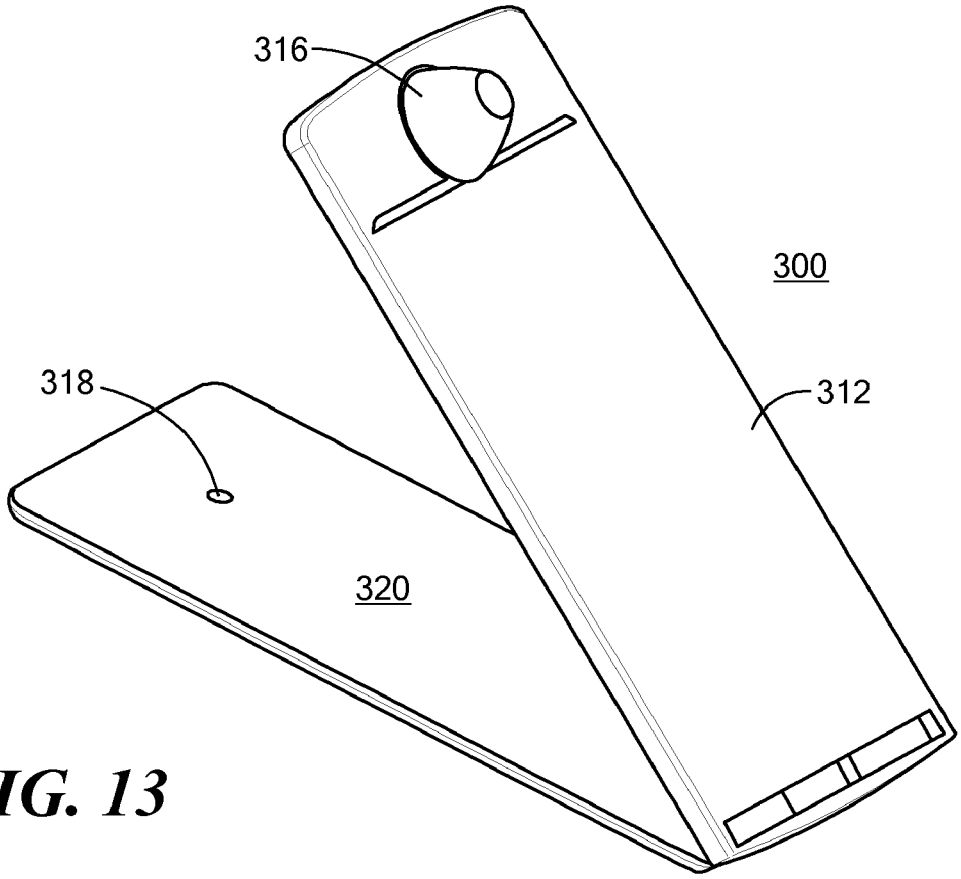
FIG. 13 is a perspective view of the clamshell swing ticket holder of FIG. 11.

Referring now to FIGS. 11-13, another alternative embodiment of the present invention is illustrated. FIG. 11 illustrates a front view of swing ticket holder 300. FIG. 12 illustrates a side view of swing ticket holder 300. FIG. 13 illustrates a perspective view of swing ticket holder 300. Swing ticket holder 300 is similar to the previously described embodiments in that it includes a generally flat rigid plastic housing 312 which is at least partially transparent to allow viewing of printed matter enclosed therein. The housing 312 is illustrated as having a clamshell configuration, however the invention is not limited in that regard. The housing 312 can also be constructed to include a slot 314 which allows insertion of the swing ticket (not shown). In this embodiment, a clutch mechanism to receive a locking pin (not shown) is integrally formed with the housing 312. The housing 312 can include a protrusion 316 which houses a clutch mechanism therein for engagement with a pin. An aperture 318 in one side 320 of the housing 312 is coincident with the clutch mechanism. A pin (not shown) may be inserted into the aperture 318 and engaged with the clutch mechanism to secure an item to the swing ticket holder 300. Additionally, the card 36 from FIG. 5, containing EAS 38 and/or RFID 40 elements may also be used with this alternative embodiment to include RFID capabilities and/or if an EAS hard tag pin/clutch is not used.

Figure 14:
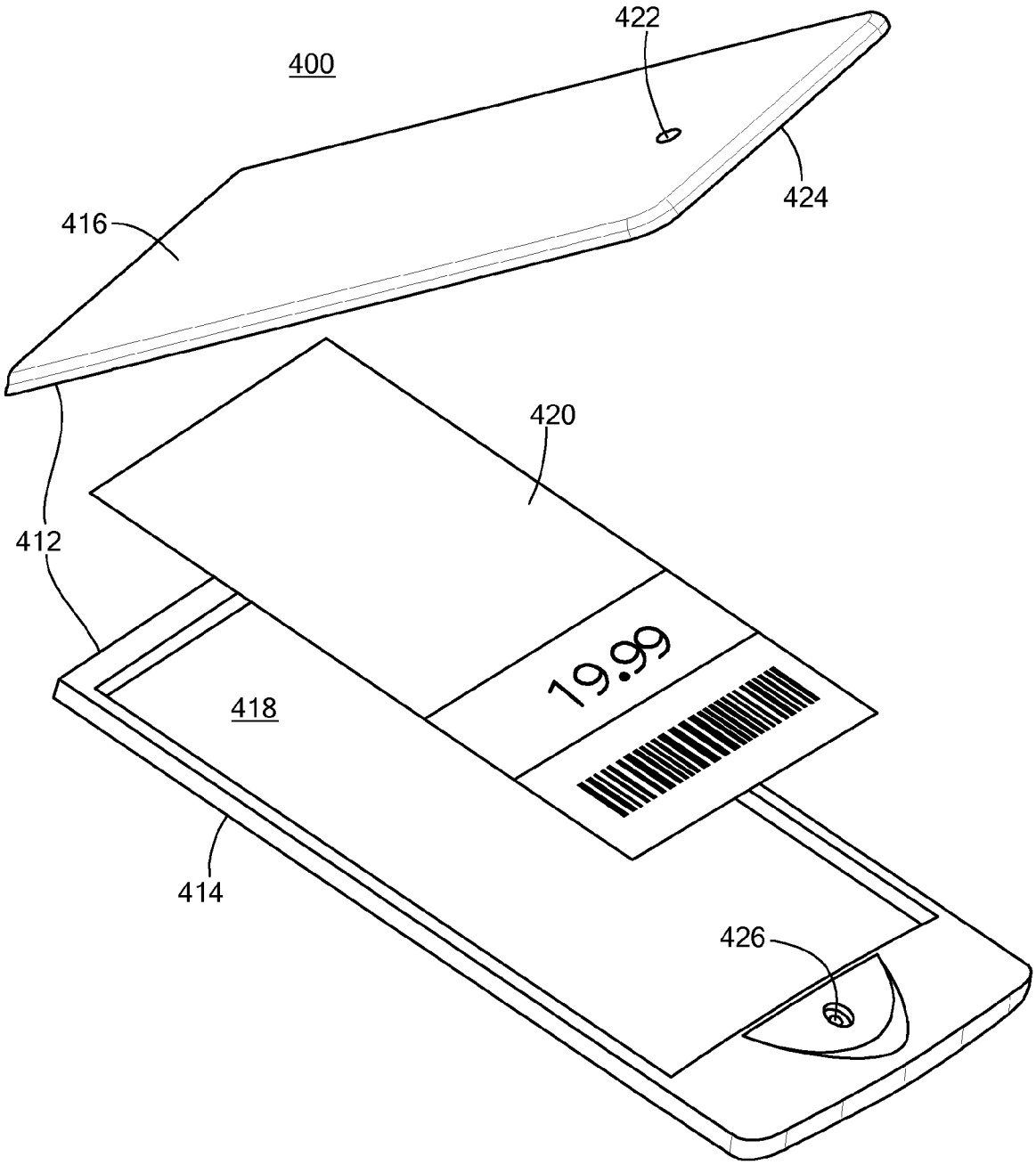
FIG. 14 is an exploded view of yet another alternative embodiment of a swing ticket holder having a housing with a removable cover, constructed in accordance with the principles of the present invention.

Referring now to FIG. 14, another alternative of the present invention is shown. FIG. 14 is an exploded view of swing ticket holder 400. Swing ticket holder 400 includes a two-piece rigid housing 412 consisting of a lower housing piece 414 and a removable upper housing piece 416. The lower housing piece 414 includes a cavity 418, while the removable upper housing piece 416 is generally planar. This configuration allows a printed ticket 420 and EAS/RFID components, such as those shown on card 36 of FIG. 5, to be inserted into the cavity 418 and removed as needed. The upper housing piece 416 includes a first aperture 422 positioned near the upper edge 424 of upper housing piece 416, which substantially aligns with a second aperture 426 in the lower housing piece 414 when the housing 412 is in a closed position. The housing 412 may be secured in a closed position by inserting a pin component from an EAS hard tag (not shown) through both apertures 422, 426 and then engaging the pin with the clutch component of the EAS hard tag. Again, the card 36 from FIG. 5, containing EAS 38 and/or RFID 40 elements may also be used with this alternative embodiment to include RFID capabilities and/or if an EAS hard tag pin/clutch is not used.

Figure 15:
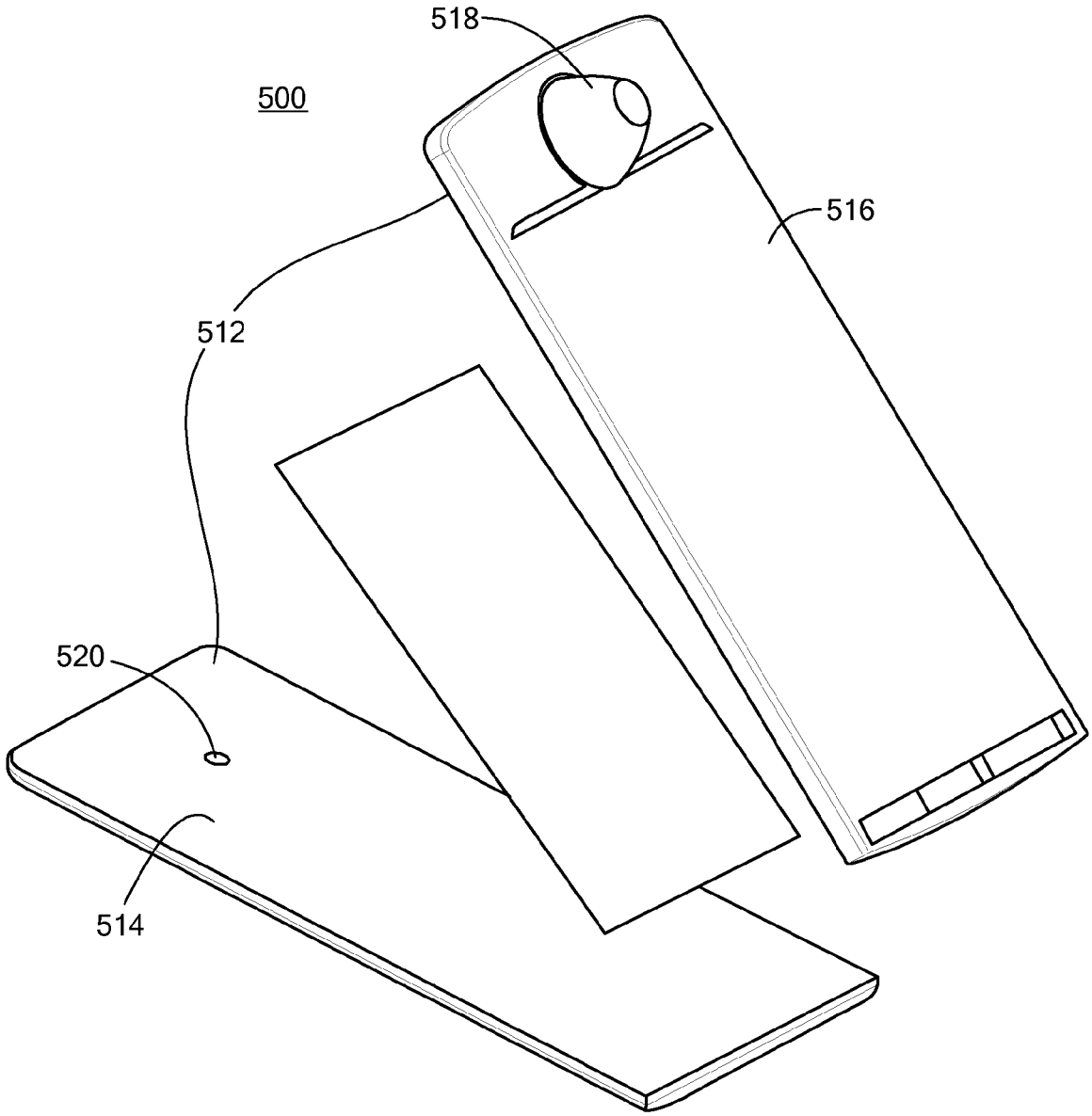
FIG. 15 is an exploded view of yet another alternative embodiment of a swing ticket holder having a housing with a removable cover and an integrated clutch mechanism, constructed in accordance with the principles of the present invention.

Referring now to FIG. 15, yet another alternative embodiment of the present invention is shown. Similar to the swing ticket holder 400 shown in FIG. 14, swing ticket holder 500 consists of a housing 512 having a two-piece design, e.g., lower housing piece 514 and upper housing piece 516. However, swing ticket holder 500 also includes an integrated clutch mechanism to receive a locking pin (not shown) integrally formed in one of the housing pieces. In this embodiment, upper housing piece 514 includes a protrusion 518 which houses a clutch mechanism therein for engagement with a pin. An aperture 520 in the lower housing piece 516 of the housing 512 is coincident with the clutch mechanism. A pin (not shown) may be inserted into the aperture 520 and engaged with the clutch mechanism to secure an item to the swing ticket holder 500. The card 36 from FIG. 5, containing EAS 38 and/or RFID 40 elements may also be used with this alternative embodiment to include RFID capabilities and/or EAS capabilities if an EAS hard tag pin/clutch is not used.

Figure 16:
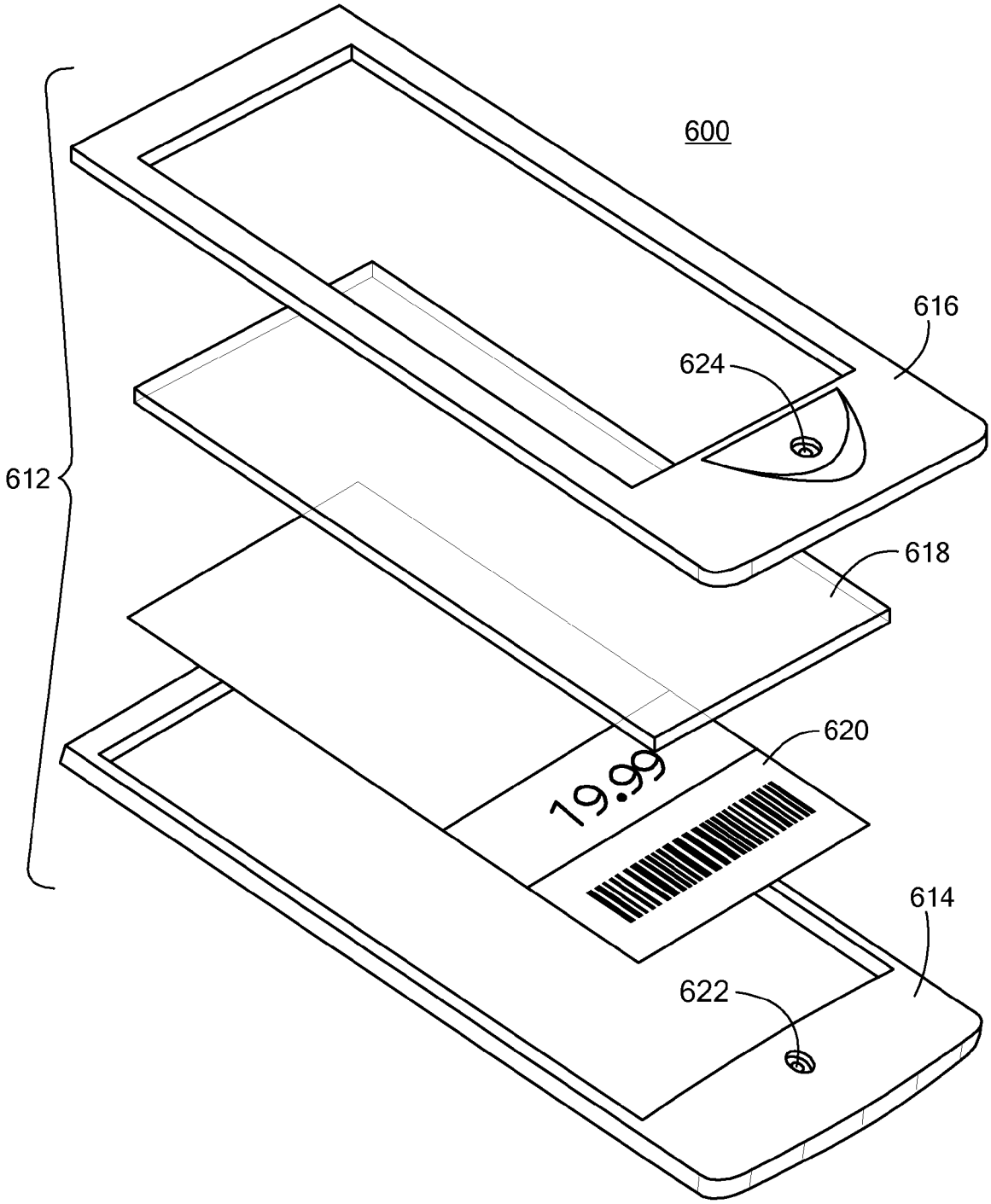
FIG. 16 is an exploded view of another alternative embodiment of a swing ticket holder having a three piece housing constructed in accordance with the principles of the present invention.

Referring now to FIG. 16, another alternative embodiment of the present invention is provided. Swing ticket holder 600 includes a housing 612 having a three-piece design, e.g., lower housing piece 614, upper housing piece 616 and a transparent window cover 618 through which the cardstock ticket 620 may be viewed. In the embodiment shown in FIG. 16, the lower housing piece 614 includes a first aperture 622 and the upper housing piece 616 includes a corresponding second aperture 624 which align together when the swing ticket housing 612 is in a closed position. A locking pin may be inserted through the apertures 622, 624 into a corresponding lock, such as found on existing EAS hard tags (not shown) to retain the swing ticket holder to the item of merchandise. Alternatively, swing ticket holder 600 may include either an integrated clutch mechanism to receive a locking pin or the locking pin itself (not shown) integrally formed in one of the housing pieces. Additionally, the card 36 from FIG. 5, containing EAS 38 and/or RFID 40 elements may be used with this alternative embodiment to include RFID capabilities and/or EAS capabilities if an EAS hard tag pin/clutch is not used.

Embodiments of the swing ticket holder of the present invention may protect any type of EAS sensor technology, and/or any type of RFID sensor, e.g., passive, active, semi-passive, HF, UHF, etc. The swing ticket holder may be constructed using a 1, 2 or 3 piece design, and can include technology and non-technology versions. The swing ticket holder also protects the printed material on the swing ticket from bending, tearing, switching and loss. There may be various possible configurations of the design, including a non-clutch version to be used with existing EAS hard tags, as well as an internal clutch version to be used with a standard tack. A swing ticket is placed inside the holder, along with any other sensors required. The complete holder is then attached to the item. At the point of sale, the swing ticket holder is removed and recycled back into inventory, and the customer keeps the swing ticket. Any of the above-described embodiments of the swing tag holder may also be configured to have integral EAS and/or RFID components.

The rigid construction of the swing ticket holder is structurally superior to previous solutions. The attachment method of the swing ticket holder uses a hard steel pin to connect a rigid plastic holder to an item of merchandise, instead of a thin plastic part connecting the actual unprotected ticket directly to the item.

The hard polymer material of the swing ticket holder is difficult to distort and attack. The swing ticket and sensors are better protected inside the swing ticket holder. The use of a steel pin to secure the swing ticket holder to the merchandise prevents it from being removed without tools, or inadvertently removed under normal use.

The swing ticket holder may include a mechanical clutch, to be used with an EAS type pin. The swing ticket holder can also include no clutch and be used with existing EAS hard tags such as those that may already be owned by the merchant.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A swing ticket holder for securing a swing ticket to an item using a lock and a pin, the swing ticket holder comprising:

a rigid housing arranged to retain the swing ticket, the rigid housing having a first portion defining a cavity to allow removable insertion of the swing ticket within the cavity, the rigid housing being arranged to allow the pin to extend outwardly from the rigid housing for insertion into the lock to secure the swing ticket holder to the item.

2. The swing ticket holder of claim 1, further comprising a card with at least one of an electronic article surveillance element and a radio frequency identification element disposed thereon, the card being retained within the rigid housing.

3. The swing ticket holder of claim 1, wherein the rigid housing further has a first edge opposite a second edge, the rigid housing defining at least one aperture located proximate the first edge through which the pin may be inserted into the lock.

4. The swing ticket holder of claim 1, wherein the rigid housing further has a generally planar configuration, a first edge opposite a second edge, and a second portion that collectively further define the cavity such that when the first portion is aligned above the second portion to form a closed position, the cavity is defined between the first portion and the second portion to allow retention of the swing ticket within the cavity.

5. The swing ticket holder of claim 4, wherein the first portion defines a first aperture and the second portion defines a second aperture such that when in the closed position, the first aperture substantially aligns with the second aperture to allow insertion of the pin through both the first aperture and the second aperture.

6. The swing ticket holder of claim 4, wherein the first portion is hingedly connected to the second portion along one of the edges.

7. The swing ticket holder of claim 4, wherein the rigid housing further includes:

a protrusion extending from one of the first portion and the second portion; and a lock contained within the protrusion such that when the first portion and the second portion are in the closed position, the lock substantially aligns with the aperture to accept and secure the pin.

8. An electronic article surveillance ("EAS") system for securing a swing ticket to an item of merchandise, the EAS system comprising:

a swing ticket holder having a rigid housing arranged to retain the swing ticket, the rigid housing having a first portion defining a cavity to allow removable insertion of the swing ticket within the cavity;

an EAS hard tag; and a pin securing the swing ticket holder to the EAS hard tag through the item of merchandise.

9. The EAS system of claim 8, further comprising a card with radio frequency identification elements, the card being retained within the swing ticket holder.

10. The EAS system of claim 8, wherein the EAS hard tag includes a lock, the pin extending outwardly from the rigid housing and being insertable into the lock to secure the swing ticket holder to the item of merchandise.

11. The EAS system of claim 10, wherein the rigid housing further has a first edge opposite a second edge, the rigid housing defining at least one aperture located proximate the first edge through which the pin may be inserted into the lock.

12. The EAS system of claim 10, wherein the rigid housing further has a generally planar configuration, a first edge opposite a second edge, and a second portion that collectively further define the cavity such that when the first portion is aligned above the second portion to form a closed position the cavity is defined between the first portion and the second portion to allow retention of the swing ticket within the cavity.

13. The EAS system of claim 10, wherein the first portion defines a first aperture and the second portion defines a second aperture such that when in the closed position, the first aperture substantially aligns with the second aperture to allow insertion of the pin through both the first aperture and the second aperture.

14. The EAS system of claim 10, wherein the first portion is hingedly connected to the second portion along one of the edges.

15. A method for securing a swing ticket to an item of merchandise, the method comprising:

removably inserting a swing ticket into a cavity of a swing ticket holder; and securing the swing ticket holder to the item of merchandise by inserting a pin through the item into a lock, the pin extending from the swing ticket holder.

16. The method of claim 15, wherein the lock is an electronic article surveillance hard tag.

17. The method of claim 15, wherein the swing ticket holder includes a rigid housing arranged to retain the swing ticket, the rigid housing having a first edge opposite a second edge, the pin extending outwardly from the rigid housing and being insertable into the lock through the item of merchandise.

18. The method of claim 17, wherein the rigid housing has a generally planar configuration, a first edge opposite a second edge, and a first portion and a second portion collectively defining the cavity such that when the first portion is aligned above the second portion to form a closed position, the cavity is defined between the first portion and the second portion to allow retention of the swing ticket within the cavity.

19. The method of claim 18, wherein the first portion defines a first aperture and the second portion defines a second aperture such that when in the closed position, the first aperture substantially aligns with the second aperture to allow insertion of the pin through both the first aperture and the second aperture.

20. The method of claim 17, wherein the rigid housing further includes:

a protrusion extending from one of the first portion and the second portion; and a lock contained within the protrusion such that when the first portion and the second portion are in the closed position, the lock substantially aligns with the aperture to accept and secure the pin.

* * * * *